United States Patent [19]

Ikenoue et al.

[11] Patent Number: 4,588,441

[45] Date of Patent: May 13, 1986

[54] PROCESS FOR THE PREPARATION OF SINTERED ALLOYS FOR VALVE MECHANISM PARTS FOR INTERNAL COMBUSTION ENGINES

[76] Inventors: Yutaka Ikenoue, 5-4-2, Tokiwadaira, Matsudo-shi, Chiba-ken; Hiroyuki Endoh, 741-3, Tsukushino, Abiko-shi, Chiba-ken; Tadao Hayasaka, 1-13-10, Kaga-cho, Kashiwa-shi, Chiba-ken, all of Japan

[21] Appl. No.: 575,713

[22] Filed: Jan. 31, 1984

[30] Foreign Application Priority Data

Feb. 8, 1983 [JP] Japan ..... 58-20292

[51] Int. Cl.[4] ..... B22F 3/16; C22C 33/02; C22C 38/12; C22C 38/16

[52] U.S. Cl. ..... 75/230; 419/2; 419/11; 419/53; 419/54; 419/55

[58] Field of Search ..... 75/243, 241, 230; 419/11, 23, 2, 10, 38, 53, 54, 55, 56, 32

[56] References Cited

U.S. PATENT DOCUMENTS

| | | | |
|---|---|---|---|
| 3,977,838 | 8/1976 | Hashimoto et al. | 419/11 |
| 3,982,905 | 9/1976 | Ogawa et al. | 75/243 |
| 4,207,120 | 6/1980 | Armstrong et al. | 419/11 |
| 4,233,073 | 11/1980 | Takemura et al. | 419/11 |
| 4,344,795 | 8/1982 | Endo et al. | 75/243 |

FOREIGN PATENT DOCUMENTS

| | | | |
|---|---|---|---|
| 58-153703 | 9/1983 | Japan | 419/11 |
| 482247 | 8/1975 | U.S.S.R. | 419/11 |

*Primary Examiner*—Allan M. Lieberman
*Attorney, Agent, or Firm*—Berman, Aisenberg & Platt

[57] ABSTRACT

A process for the preparation of an iron base sintered alloy well suited for use in valve mechanism members or parts of internal combustion engines, which has a porosity of 5 to 15% and throughout the iron matrix of which is dispersed an Fe-Mo intermetallic compound in the form of a phase harder than the said matrix, by using a powder mixture obtained by incorporating into finely divided iron powders having a particle size of not more than 30 microns the given amounts of copper powders, phosphorus-containing alloy powders, carbon powders and Fe-Mo alloy powders, or the given amounts of bronze powders and/or a mixture of copper powders and tin powders, phosphorus-containing alloy powders, carbon powders and Fe-Mo alloy powders.

wherein the said iron powders are granulated alone or in combination with other powders to an apparent particle size of 30 to 200 microns, and the obtained powder mixture is formed into a green compact having a density ratio of 75 to 85%, which is in turn sintered at a temperature of 1030°–1130° C. in a reducing atmosphere.

19 Claims, 5 Drawing Figures

PROCESS FOR THE PREPARATION OF SINTERED ALLOYS FOR VALVE MECHANISM PARTS FOR INTERNAL COMBUSTION ENGINES

FIELD OF THE INVENTION

The present invention relates to an iron-base sintered alloy which is best suited for use in wear-resistant parts, such as members forming valve mechanisms for internal combustion engines, inclusive of rocker arms and valve lifters.

BACKGROUND OF THE INVENTION

Since these parts slide against their associated parts under high pressures, it is of vital importance that they are not only wear-resistant in themselves, but they do not also wear away their associated parts. The conventional parts of this type are formed of steel or cast iron and are improved in respect of wear resistance by chilling, spraying of autogenous alloys or hard-chromium plating. However, some problems arise in connection with cost and performance. Thus there is still an increasing demand for the development of more satisfactory materials.

It is known in the art that, in some cases, a so-called dispersion-hardened type of sintered alloy, viz., a sintered alloy having a metal matrix throughout in which is dispersed a phase harder than the said matrix, is well suited for such application. However, this type of alloy has its properties affected noticeably by the nature and density ratio (say, porosity) of the matrix as well as the component and distribution of the hard phase. This leads to difficulties encountered in the steady production of alloys having the desired properties, too.

SUMMARY OF THE INVENTION

In an intensive effort to prepare improved alloys, it has been found that the best wear resistance is obtained if an iron-base sintered alloy serving as a matrix or substrate has a porosity ranging from 5 to 15%, and an Fe-Mo intermetallic compound in the form of a hard phase is dispersed throughout the matrix in an area ratio of 5 to 25%.

The present invention, which does lay the groundwork on such findings, provides in essence a process for the preparation of an iron-base sintered alloy having a porosity of 5 to 15%, throughout the iron matrix in which is dispersed an Fe-Mo intermetallic compound in the form of a phase harder than the said matrix.

According to one aspect of the present invention, when finely divided iron powder having a particle size of not more than 30 microns is combined with desired quantities of copper powder, a phosphorus-containing alloy powder, carbon powder and an Fe-Mo alloy powder, the iron powder is granulated alone or in combination with other powders to an apparent particle size of 30 to 200 microns. The obtained powder mixture is formed into a green compact having a density ratio of 75 to 85%, which is then sintered at 1030°–1130° C. in a reducing atmosphere.

According to another aspect of the present invention, atomized or reduced iron powder is combined with the given amounts of (a) at least one of copper powder, (copper and tin powder) and bronze powder, (b) phosphorus-containing alloy powder, (c) carbon powder and (d) Fe-Mo alloy powders; the resulting formulations are formed into green compacts having a density ratio of 70–90%; and the green compacts are pre-sintered at a temperature of 300°–900° C., followed by re-compression until a density ratio of 90–95% is reached; and sintering is then effected at 1030°–1130° C. in a reducing atmosphere.

BRIEF DESCRIPTION OF THE DRAWINGS

The above-mentioned and other features of the present invention will become apparent from the following detailed description with reference to the accompanying drawings, in which.

PREFERRED EMBODIMENTS OF THE INVENTION

Figure 1:
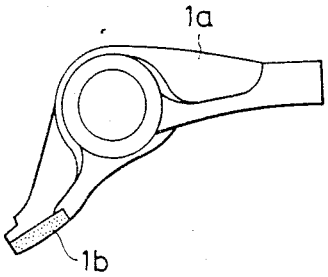
FIG. 1 is a view showing a rocker arm body 1*a* of an internal combustion engine, to which a pad 1*b* is attached.

In the present invention, as the raw material for iron use may be made of, e.g., finely divided iron powder having a particle size of not more than 30 microns, such as carbonyl iron powder. Such powder are then formed and sintered under specific conditions. Use may also be made of ordinary iron powders, such as atomized or reduced iron powders; however, usch powders are then formed, pre-sintered, repressed and sintered under the specific conditions.

It is noted that powder of atomized or reduced iron ordinarily used in powder metallurgy provides a sintered compact having a density ratio of not more than 85% (i.e., a porosity of not less than 15%;, which is poor in wear resistance (refer to Sample No. 31 given in Table 3 to be set forth later).

In one experimental run carbonyl iron powder was used as finely divided iron powder, and in another run reduced iron powder was employed.

Having a particle size of not more than 30 microns, the carbonyl iron powder has poor flowability during compacting and is prone to segregation. Thus a problem arises when such powder is used directly without any treatment. For use, the carbonyl iron powder should be granulated to an apparent particle size of 30 to 200 microns. As that granulation is effected with a view to improving flowability, it suffices if the carbonyl iron powder is granulated either alone or in combination with powder of other additives. The carbonyl iron powder is a main ingredient which amounts to more than 50% of the sintered alloy according to the present invention.

The present invention will now be elucidated further with reference to one embodiment wherein it is applied to the rocker arm pad of an automotive engine.

PREPARATION OF SAMPLES

Example 1

A powder mixture consisting of 2% of naturally occurring graphite, 10% of powdery Cu-10Sn bronze, 10% of a powdery Fe-62Mo alloy, 2% of a powdery Fe-25P alloy, 0.5% of zinc stearate and the balance being granulated carbonyl iron powder (having an average particle size of 5 microns prior to granulation) was prepared. The powder mixture was then placed in a mold to obtain a number of green compacts having a density of 6.4 g/cm$^3$, some being samples for the determination of mechanical properties and the other rocker arm pad compacts of the desired shape. These compacts were sintered at 1050° C. for 20 minutes in a cracked ammonia gas atmosphere to prepare sample No. 1. The obtained sintered compacts were found to have a porosity of 10% and have an Fe-Mo intermetallic compound (hard phase) dispersed throughout its matrix in an area ratio of 14%.

Example 2

The procedures of Example 1 were repeated, provided that the green compact had a density of 5.8 g/cm$^3$.

Example 3

The procedures of Example 1 were repeated, provided that the green compact had a density of 6.0 g/cm$^3$.

Example 4

The procedures of Example 1 were repeated provided that the green compact had a density of 6.8 g/cm$^3$.

Example 5

The procedures of Example 1 were repeated, provided that the green compact had a density of 7.1 g/cm$^3$.

Example 6

The procedures of Example 1 were repeated, provided that sintering was carried out at 1000° C.

Example 7

The procedures of Example 1 were repeated, provided that sintering was conducted at 1030° C.

Example 8

The procedures of Example 1 were repeated, provided that sintering was conducted at 1130° C.

Example 9

The procedures of Example 1 were repeated, provided that sintering was carried out at 1160° C.

Example 10

The procedures of Example 1 were repeated, provided that the amount of Fe-62Mo alloy powders used was 4.8%.

Example 11

The procedures of Example 1 were repeated, provided that the amount of Fe-62Mo alloy powders used was 8.1%.

Example 12

The procedures of Example 1 were repeated, provided that the amount of Fe-62Mo alloy powders used was 24.2%.

Example 13

The procedures of Example 1 were repeated, provided that the amount of Cu-10Sn bronze powders used was 3%.

Example 14

The procedures of Example 1 were repeated, provided that the amount of CU-10Sn bronze powders used was 5%.

Example 15

The procedures of Example 1 were repeated, provided that the amount of Cu-10Sn bronze powders used was 20%.

Example 16

The procedures of Example 1 were repeated, provided that the amount of Cu-10Sn bronze powders used was 25%.

Example 17

The procedures of Example 1 were repeated, provided that 3% of electrolytic copper powders were used in place of the Cu-10Sn bronze powders.

Example 18

The procedures of Example 1 were repeated, provided that 5% of electrolytic copper powders was used in place of the Cu-10Sn bronze powders.

Example 19

The procedures of Example 1 were repeated, provided that 10% of electrolytic copper powders was used in place of the Cu-10Sn bronze powders.

Example 20

The procedures of Example 1 were repeated, provided that 20% of electrolytic copper powders was used in place of Cu-10Sn bronze powders.

Example 21

The procedures of Example 1 were repeated, provided that 25% of electrolytic copper powders was used in place of Cu-10Sn bronze powders.

Example 22

The procedures of Example 1 were repeated, provided that the amount of Fe-25P alloy powders used was 0.4%.

Example 23

The procedures of Example 1 were repeated, provided that the amount of Fe-25P alloy powders used was 0.8%.

Example 24

The procedures of Example 1 were repeated provided that the amount of Fe-25P alloy powders used was 6%.

Example 25

The procedures of Example 1 were repeated, provided that the amount of Fe-25P alloy powders used was 8%.

Example 26

The procedures of Example 1 were repeated, provided that the amount of natural graphite powders used was 0.5%.

Example 27

The procedures of Example 1 were repeated, provided that the amount of natural graphite powders used was 1%.

Example 28

The procedures of Example 1 were repeated, provided that the amount of natural graphite powders used was 3%.

Example 29

The procedures of Example 1 were repeated, provided that the amount of natural graphite powders used was 4%.

Example 30

The procedures of Example 1 were repeated, provided that 9% of electrolytic copper powders and 1% of stamped Sn powders were employed in place of the Cu-10Sn bronze powders.

Example 31

A mixture of 2% of natural graphite powders, 10% of Cu-10Sn bronze powders, 10% of Fe-62Mo alloy powders, 2% of Fe-25P alloy powders, 0.5% of zinc stearate and the balance being reduced iron powders was prepared and placed in a mold. Green compacts having a density of 6.4 g/cm$^3$ are formed in the form of test pieces of the given shape for the determination of mechanical properties and the given rocker arm pads. The green compacts were sintered at a temperature of 1050° C. for 20 minutes in a cracked ammonia gas atmosphere to obtain Sample No. 31. The sintered bodies had a porosity of 17.5%.

Example 32

A mixture of 2% of natural graphite powders, 10% of Cu-10Sn bronze powders, 10% of Fe-62Mo alloy powders, 2% of Fe-25P alloy powders, 0.5% of zinc stearate and the balance being reduced iron powders was prepared and placed in a mold. A number of green compacts having a density of 6.4 g/cm$^3$ were formed in the form of rocker arm pads and test pieces of the given shape for determining the mechanical properties thereof. The green compacts were pre-sintered at 700° C. for 20 minutes in a cracked ammonia gas atmosphere, and again placed in the mold wherein they were repressed into a density ratio of 93%. The repressed bodies were sintered at 1050° C. for 20 minutes in a cracked ammonia gas atmosphere to obtain Sample No. 32. The sintered bodies had a porosity of 10% with the Fe-Mo intermetallic compound dispersed throughout its matrix being 14% in terms of the area ratio.

Example 33

The procedures of Example 32 were repeated, provided that pre-sintering was conducted at 100° C.

Example 34

The procedures of Example 32 were repeated, provided that pre-sintering was carried out at 300° C.

Example 35

The procedures of Example 32 were repeated, provided that pre-sintering was conducted at 900° C.

Example 36

The procedures of Example 32 were repeated, provided that pre-sintering was effected 1000° C.

In the following tables, the inventive samples are indicated by a mark * in the remarks columns. In particular, sample No. 1 is indicated by ** for the purpose of emphasizing that it gives rise to the best results.

With the samples exclusive of Nos. 17 to 21, copper and tin were added in the form of powdery bronze but, in sample No. 30, the given quantities of copper and tin powders were added independently. In samples Nos. 32 to 36 the carbonyl iron powder was substituted with the powders of reduced iron, a raw powdery material for powder metallurgy. Such powders were formed, pre-sintered, repressed and sintered. Sample No. 31 was obtained by forming and sintering of reduced iron powders.

Pad members **1*b* were cut out of these samples for pads, and brazed to the given position of a rocker arm body 1*a*, made of cast iron, as shown in FIG. 1**.

WEAR RESISTANCE TESTING METHOD

Figure 2:
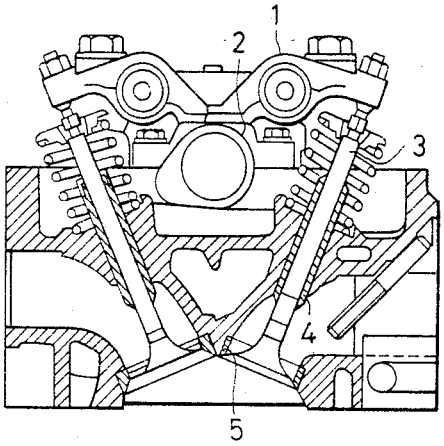
FIG. 2 is a view illustrative of a cylinder head portion of the OHC type engine.

FIG. 2 shows the cylinder head portion of an ordinary automotive engine (OHC type). A rocker arm 1 seesaws with its shaft acting as a fulcrum, as a cam 2 rotates in unison with its cam shaft. The other end of the arm 1 provided a mechanism for opening and closing of a valve 3. Reference numeral 4 is a valve guide, and 5 is a valve seat.

The cylinder head was mounted on a motoring test machine (a sort of simulator wherein a cam shaft is rotated by a motor for a variety of testing) for wear testing of the cam and pad performed under the following conditions.

TESTING CONDITIONS

Type of Engine: OHC type, four-cylinder engine of 1800 cc;

Material of Relative Cam: Chilled Cast Iron Material;

Revolutions per Minute (r.p.m.): 650;

Time of Continuous Operation: 200 hours;

Lubricant: Degraded Engine Oil obtained from a diesel car after a mileage of about 10,000 Km (to choose severer conditions).

MEASUREMENT OF MATERIAL PROPERTIES

Figure 3:
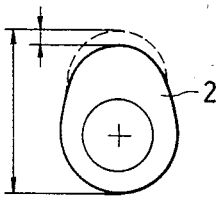
FIG. 3 and FIG. 4 are views illustrative of the manner for measuring the abrasion or wear loss of the pad 1*b* and a cam 2, respectively.

To determine the wear loss of the pad **1*b*, its shape before testing was compared with that after testing, as shown in FIG. 3** wherein a dotted line indicates the shape-before-testing and a solid line the shape-after-testing. The maximum value of abrasion as indicated by arrows is here taken as the wear loss of a sample.

Figure 4:
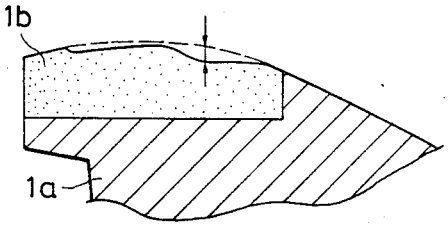

As shown in FIG. 4, the wear loss of a cam sample is here defined as a difference in the longitudinal length of the cam before and after testing.

Tables 1 to 4 also give, together with the results of wear testing, the tensile strength and impact value measurements determined with the aid of a material testing machine.

CONSIDERATIONS

From the results given in the tables, it is evident that sample No. 1 provides the best material for pads, since that material per se suffers a lower degree of abrasion, and reduces considerably the abrasion of the relative material.

The present invention will now be explained in detail with reference to the factors, viz., composition and preparation conditions, of this material.

Figure 5:
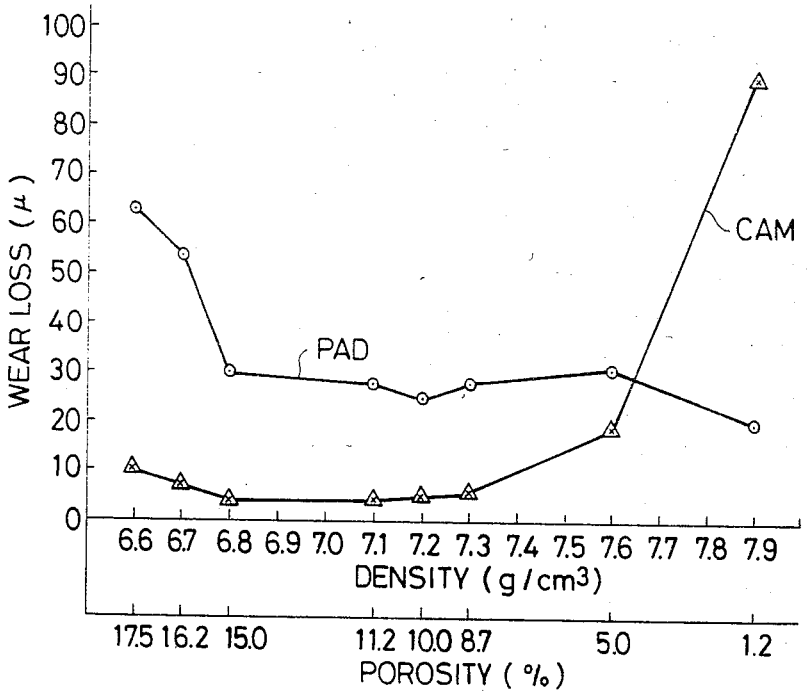
FIG. 5 is a view illustrative of the influence the porosity has on the wear resistance of the pad and cam.

Referring first to the porosity of the material, when used as a rocker arm or valve lifter, the pores of the material function as oil reservoirs so that the abrasion of the material is reduced or limited. However, any satisfactory effect is not obtained in a porosity below 5%, whereas, in a porosity exceeding 15%, the bonding among the iron particles forming the matrix becomes so weak that there is an increasing tendency toward abrasion. Therefore, the porosity of the material is preferably in a range of 5 to 15%. The graphical view of FIG. 5 illustrates that, when the pad has a porosity of more than 15%, it wears away, and when the pad has a porosity below 5%, the associated cam wears away markedly.

Incidentally, the porosity of a sintered mass obtained by forming and sintering of carbonyl iron powders is determined depending upon two factors, the density and sintering temperature of a green compact, which have a great influence simultaneously upon the mechanical and other characteristics of the sintered compact. Taken altogether, it is noted that better results are obtained when the density of the green compact is adjusted to a density ratio of 75 to 85%, and the green compact is sintered at a temperature of 1030° to 1130° C. (refer to samples Nos. 1 to 9 inclusive, of Table 1).

Referring to the sintered bodies obtained by forming, pre-sintering, repressing and sintering of reduced iron powders, when pre-sintering is carried out at a temperature below 300° C. or above 900° C., a density ratio of no more than 90% is reached after repressing and sintering with no desired results being obtained as a consequence (see Table 4).

Reference will then be made to the components and the composition range.

Molybdenum is an essential ingredient for the formation of a hard phase excelling in wear resistance. For sufficient wear resistance, and Fe-Mo intermetallic compound has to be dispersed throughout the matrix in an area ratio of 5 to 25%. To this end, 3 to 15% of molybdenum should be used. Below the lower limit, the wear resistance required is not obtained since insufficient formation of the hard phase takes place. Above the upper limit, on the other hand, molybdenum does not give rise to further advantages. An incurs and economical disadvantage because of its high price. Molybdenum is preferably added in the form of Fe-Mo powders, rather than in the pure form.

Copper or its alloy (bronze) diffuses partly into the iron matrix during sintering to improve the strength thereof. Another part of copper or its alloy does not diffuse into the matrix to improve compatibility with respect to the relative member during sliding, thus preventing the abrasion of the relative member. To this end, copper or its alloy is preferably added in an amount of 5 to 20% (see samples Nos. 13 to 21, inclusive). The above-mentioned effect is little or not obtained below the lower limit. The addition of copper or its alloy in an amount exceeding 20% makes worse the bonding among the iron particles forming the matrix, and causes a substantial drop in wear resistance and strength. A preferable copper alloy is a Cu-Sn alloy which is added as independent copper and tin powders or in the form of bronze. However, preference is given to the use of bronze powders since better results are then attained, as will appreciated from a comparison of sample No. 30 with sample No. 1 of Table 3. Cu-P alloy powders may be used; these serve also as phosphorus-containing alloy powders. However, this is preferably avoided in view of compatibility.

Phosphorus diffuses into the matrix and contributes to the reinforcement thereof. This element is added in the form of Fe-P or Cu-P alloy powders in an amount of from 0.2 to 1.5%, calculated as elemental phosphorus. No desired effect is substantially obtained below the lower limit. The addition of phosphorus in an amount exceeding 1.5% renders the matrix so brittle that bad results are obtained. In this respect, see samples Nos. 22 to 25.

Carbon is an essential ingredient which forms a solid solution with the iron matrix to yield a carbide attributable to improvements in wear resistance. Carbon has only a little effect in an amount below 1%, whereas it causes precipitation in larger amounts in network cementite, as a result of which abrasion of the relative material is promoted.

As explained above, the present invention can provide a process for the preparation of a sintered alloy excelling in wear resistance and which makes a great contribution to increases in the service life of valve system members.

TABLE 1

| Sample No. | Chemical Components (% by weight) Mo | Cu | Sn | P | C | Fe | Compact Density g/cm³ | Density Radio of Compact % | Sintering Temperature °C. | Sintering Density g/cm³ | Porosity of Sintered Compact % |
|---|---|---|---|---|---|---|---|---|---|---|---|
| 1 | 6.2 | 9.0 | 1.0 | 0.5 | 2.0 | Bal | 6.4 | 80.0 | 1050 | 7.2 | 10.0 |
| 2 | " | " | " | " | " | " | 5.8 | 72.5 | " | 7.3 | 8.7 |
| 3 | " | " | " | " | " | " | 6.0 | 75.0 | " | 7.1 | 11.2 |
| 4 | " | " | " | " | " | " | 6.8 | 85.0 | " | 6.8 | 15.0 |
| 5 | " | " | " | " | " | " | 7.1 | 88.8 | " | 6.7 | 16.2 |
| 6 | " | " | " | " | " | " | 6.4 | 80.0 | 1000 | 6.7 | 16.2 |
| 7 | " | " | " | " | " | " | " | " | 1030 | 7.0 | 12.5 |
| 1 | " | " | " | " | " | " | " | " | 1050 | 7.2 | 10.0 |
| 8 | " | " | " | " | " | " | " | " | 1130 | 7.0 | 12.5 |
| 9 | " | " | " | " | " | " | " | " | 1160 | 7.0 | 12.5 |

| Sample No. | Chemical Components (% by weight) Mo | Cu | Sn | P | C | Fe | Area Ratio of Hard Phase % | Tensile Strength kg/mm² | Impact Value kg-m/cm² | Wear Loss μ Pad | Cam | Remarks |
|---|---|---|---|---|---|---|---|---|---|---|---|---|
| 1 | 6.2 | 9.0 | 1.0 | 0.5 | 2.0 | Bal | 14 | 40 | 0.25 | 25 | 5 | ** Density |
| 2 | " | " | " | " | " | " | " | 42 | 0.25 | 28 | 6 | Ratio of |
| 3 | " | " | " | " | " | " | " | 40 | 0.25 | 28 | 4 | * Compact |
| 4 | " | " | " | " | " | " | " | 38 | 0.25 | 30 | 4 | * |

TABLE 1-continued

| | | | | | | | | | | | | |
|---|---|---|---|---|---|---|---|---|---|---|---|---|
| 5 | " | " | " | " | " | " | " | 34 | 0.22 | 54 | 7 | |
| 6 | " | " | " | " | " | " | 10 | 28 | 0.20 | 190 | 12 | Sintering |
| 7 | " | " | " | " | " | " | 12 | 38 | 0.25 | 35 | 6 | * Temperature |
| 1 | " | " | " | " | " | " | 14 | 40 | 0.25 | 25 | 5 | ** |
| 8 | " | " | " | " | " | " | 16 | 46 | 0.25 | 20 | 20 | * |
| 9 | " | " | " | " | " | " | 18 | 42 | 0.22 | 18 | 75 | |

TABLE 3

| Sample No. | Chemical Components (% by weight) Mo | Cu | Sn | P | C | Fe | Compact Density g/cm³ | Density Radio of Compact % | Sintering Tempera-ture °C. | Sintering Density g/cm³ | Porosity of Sin-tered Compact % | Area Ratio of Hard Phase % |
|---|---|---|---|---|---|---|---|---|---|---|---|---|
| 1 | 6.2 | 9.0 | 1.0 | 0.5 | 2.0 | Bal | 6.4 | 80.0 | 1050 | 7.2 | 10.0 | 14 |
| 30 | " | " | " | " | " | " | 6.4 | 80.0 | 1050 | 7.2 | 10.0 | 14 |
| 1 | " | " | " | " | " | " | 6.4 | 80.0 | 1050 | 7.2 | 10.0 | 14 |
| 31 | " | " | " | " | " | " | 6.4 | 80.0 | 1050 | 6.6 | 17.5 | 14 |

| Sample No. | Chemical Components (% by weight) Mo | Cu | Sn | P | C | Fe | Tensile Strength kg/mm² | Impact Value kg-m/cm² | Wear Loss μ Pad | Cam | Remarks |
|---|---|---|---|---|---|---|---|---|---|---|---|
| 1 | 6.2 | 9.0 | 1.0 | 0.5 | 2.0 | Bal | 40 | 0.25 | 25 | 5 | ** |
| 30 | " | " | " | " | " | " | 38 | 0.25 | 30 | 12 | * Cu, Sn alone |
| 1 | " | " | " | " | " | " | 40 | 0.25 | 25 | 5 | ** |
| 31 | " | " | " | " | " | " | 31 | 0.22 | 63 | 10 | Reduced Fe Powder |

TABLE 2

| Sample No. | Chemical Components (% by weight) Mo | Cu | Sn | P | C | Fe | Compact Density g/cm³ | Density Radio of Compact % | Sintering Tempera-ture °C. | Sintering Density g/cm³ | Porosity of Sintered Compact % |
|---|---|---|---|---|---|---|---|---|---|---|---|
| 10 | 3.0 | 9.0 | 1.0 | 0.5 | 2.0 | Bal | 6.4 | 80.6 | 1050 | 6.9 | 13.3 |
| 11 | 5.0 | " | " | " | " | " | 6.4 | 80.1 | " | 7.0 | 12.4 |
| 1 | 6.2 | " | " | " | " | " | 6.4 | 80.0 | " | 7.2 | 10.0 |
| 12 | 15.0 | " | " | " | " | " | 6.5 | 80.2 | " | 7.4 | 8.6 |
| 13 | 6.2 | 2.7 | 0.3 | " | " | " | 6.4 | 80.6 | " | 6.7 | 15.6 |
| 14 | " | 4.5 | 0.5 | " | " | " | 6.4 | 80.5 | " | 6.8 | 14.5 |
| 1 | " | 9.0 | 1.0 | " | " | " | 6.4 | 80.0 | " | 7.2 | 10.0 |
| 15 | " | 18.0 | 2.0 | " | " | " | 6.5 | 80.4 | " | 7.3 | 9.7 |
| 16 | " | 22.5 | 2.5 | " | " | " | 6.6 | 81.3 | " | 7.4 | 8.9 |
| 17 | " | 3.0 | — | " | " | " | 6.4 | 80.6 | " | 7.1 | 10.6 |
| 18 | " | 5.0 | — | " | " | " | 6.4 | 80.4 | " | 7.2 | 9.5 |
| 19 | " | 10.0 | — | " | " | " | 6.5 | 81.1 | " | 7.2 | 10.1 |
| 20 | " | 20.0 | — | " | " | " | 6.6 | 81.4 | " | 7.3 | 10.0 |
| 21 | " | 25.0 | — | " | " | " | 6.6 | 80.9 | " | 7.3 | 10.5 |
| 22 | " | 9.0 | 1.0 | 0.1 | " | " | 6.5 | 80.2 | " | 7.2 | 11.1 |
| 23 | " | " | " | 0.2 | " | " | 6.5 | 80.5 | " | 7.2 | 10.9 |
| 1 | " | " | " | 0.5 | " | " | 6.4 | 80.0 | " | 7.2 | 10.0 |
| 24 | " | " | " | 1.5 | " | " | 6.3 | 81.4 | " | 7.0 | 9.6 |
| 25 | " | " | " | 2.0 | " | " | 6.3 | 82.7 | " | 7.0 | 8.1 |
| 26 | " | " | " | 0.5 | 0.5 | " | 6.4 | 80.0 | " | 6.5 | 18.7 |
| 27 | " | " | " | " | 1.0 | " | 6.4 | 80.0 | " | 6.9 | 13.7 |
| 1 | " | " | " | " | 2.0 | " | 6.4 | 80.0 | " | 7.2 | 10.0 |
| 28 | " | " | " | " | 3.0 | " | 6.3 | 80.7 | " | 7.2 | 7.8 |
| 29 | " | " | " | " | 4.0 | " | 6.2 | 81.3 | " | 7.1 | 6.9 |

| Sample No. | Chemical Components (% by weight) Mo | Cu | Sn | P | C | Fe | Area Ratio of Hard Phase % | Tensile Strength kg/mm² | Impact Value kg-m/cm² | Wear Loss μ Pad | Cam | Remarks |
|---|---|---|---|---|---|---|---|---|---|---|---|---|
| 10 | 3.0 | 9.0 | 1.0 | 0.5 | 2.0 | Bal | 7 | 40 | 0.25 | 56 | 11 | * Amount |
| 11 | 5.0 | " | " | " | " | " | 12 | 39 | 0.25 | 24 | 8 | * of Mo |
| 1 | 6.2 | " | " | " | " | " | 14 | 40 | 0.25 | 25 | 5 | ** |
| 12 | 15.0 | " | " | " | " | " | 22 | 30 | 0.20 | 12 | 17 | * |
| 13 | 6.2 | 2.7 | 0.3 | " | " | " | 14 | 36 | 0.24 | 28 | 44 | Amount |
| 14 | " | 4.5 | 0.5 | " | " | " | 14 | 37 | 0.25 | 31 | 11 | * of |
| 1 | " | 9.0 | 1.0 | " | " | " | 14 | 40 | 0.25 | 25 | 5 | ** Bronze |
| 15 | " | 18.0 | 2.0 | " | " | " | 14 | 32 | 0.28 | 33 | 6 | * |
| 16 | " | 22.5 | 2.5 | " | " | " | 14 | 26 | 0.32 | 59 | 6 | |
| 17 | " | 3.0 | — | " | " | " | 14 | 32 | 0.25 | 39 | 62 | Amount |
| 18 | " | 5.0 | — | " | " | " | 14 | 32 | 0.25 | 35 | 12 | * of Cu |
| 19 | " | 10.0 | — | " | " | " | 14 | 38 | 0.26 | 35 | 5 | * |
| 20 | " | 20.0 | — | " | " | " | 14 | 33 | 0.29 | 36 | 8 | * |
| 21 | " | 25.0 | — | " | " | " | 14 | 28 | 0.33 | 58 | 12 | |
| 22 | " | 9.0 | 1.0 | 0.1 | " | " | 14 | 28 | 0.22 | 35 | 11 | Amount of |
| 23 | " | " | " | 0.2 | " | " | 14 | 34 | 0.25 | 33 | 5 | * Phos- |
| 1 | " | " | " | 0.5 | " | " | 14 | 40 | 0.25 | 25 | 5 | ** phorous |

TABLE 2-continued

| | | | | | | | | | | | | |
|---|---|---|---|---|---|---|---|---|---|---|---|---|
| 24 | " | " | " | 1.5 | " | " | 14 | 43 | 0.20 | 25 | 16 | * |
| 25 | " | " | " | 2.0 | " | " | 14 | 33 | 0.13 | 27 | 22 | |
| 26 | " | " | " | 0.5 | 0.5 | " | 10 | 20 | 0.30 | 234 | 35 | Amount |
| 27 | " | " | " | " | 1.0 | " | 10 | 32 | 0.25 | 39 | 28 | * of |
| 1 | " | " | " | " | 2.0 | " | 14 | 40 | 0.25 | 25 | 5 | ** Carbon |
| 28 | " | " | " | " | 3.0 | " | 16 | 32 | 0.22 | 22 | 12 | * |
| 29 | " | " | " | " | 4.0 | " | 16 | 25 | 0.18 | 25 | 33 | |

TABLE 4

| No. | Chemical Components (% by weight) Mo | Cu | Sn | P | C | Fe | Compact Density g/cm³ | Density Ratio of Compact % | Pre-sintering Temperature °C. | Re-pressed Density g/cm³ | Density Ratio of Re-pressed Body % | Sintering Temperature °C. | Sintering Density g/cm³ |
|---|---|---|---|---|---|---|---|---|---|---|---|---|---|
| 1 | 6.2 | 9.0 | 1.0 | 0.5 | 2.0 | Bal | 6.4 | 80.0 | — | — | — | 1050 | 7.2 |
| 32 | " | " | " | " | " | " | " | " | 700 | 7.4 | 7.5 | " | 7.1 |
| 33 | " | " | " | " | " | " | " | " | 100 | 6.6 | 17.5 | " | 6.5 |
| 34 | " | " | " | " | " | " | " | " | 300 | 7.1 | 11.2 | " | 6.9 |
| 35 | " | " | " | " | " | " | " | " | 900 | 7.2 | 10.0 | " | 7.0 |
| 36 | " | " | " | " | " | " | " | " | 1000 | 6.8 | 15.0 | " | 6.7 |

| No. | Chemical Components (% by weight) Mo | Cu | Sn | P | C | Fe | Porosity of Sintered Compact % | Area Ratio of Hard Phase % | Tensile Strength kg/mm² | Impact Value Kg-m/cm² | Wear Loss μ Pad | Cam | Remarks |
|---|---|---|---|---|---|---|---|---|---|---|---|---|---|
| 1 | 6.2 | 9.0 | 1.0 | 0.5 | 2.0 | Bal | 10.0 | 14 | 40 | 0.25 | 25 | 5 | ** Pre- |
| 32 | " | " | " | " | " | " | 11.2 | " | 40 | 0.25 | 28 | 5 | * sintering |
| 33 | " | " | " | " | " | " | 18.7 | " | 31 | 0.22 | 92 | 10 | Temperature |
| 34 | " | " | " | " | " | " | 13.7 | " | 38 | 0.25 | 31 | 8 | * |
| 35 | " | " | " | " | " | " | 12.5 | " | 38 | 0.25 | 30 | 12 | * |
| 36 | " | " | " | " | " | " | 16.2 | " | 32 | 0.22 | 70 | 12 | |

What is claimed is:

1. A process for the preparation of an iron-base sintered alloy, well suited for use in valve mechanism members of parts of internal combustion engines, which has a porosity of from 5 to 15% and throughout the iron matrix of which is dispersed from 5 to 25% of an Fe-Mo intermetallic compound in the form of a phase harder than the said matrix, which comprises admixing iron powder with an effective amount of each of phoshorus-containing alloy powder, carbon powder, Fe-Mo alloy powder, and at least one powder selected from the group consisting of copper powder, bronze (copper and tin alloy) powder and a combination of copper powder and tin powder; forming the resulting composition into a green compact having a density ratio of 70–90%, pre-sintering the green compact at a temperature of from 300°–900° C., repressing the pre-sintered green compact until a density ratio of from 90–95% is reached, and finally sintering the repressed bodies at a temperature of from 1030°–1130° C. in a reducing atmosphere.

2. A process according to claim 1 wherein the iron powder is atomized iron powder.

3. A process according to claim 1 wherein the iron powder is reduced iron powder.

4. A process for preparing an iron-base sintered alloy, well suited for use in a valve mechanism member or a part of an internal combustion engine, which has a porosity of from 5 to 15 persent and throughout the iron matrix of which is dispersed from 5 to 25% of an Fe-Mo intermetallic compound in the form of a phase harder than said matrix, which comprises:

incorporating into finely-divided iron powder (having a particle size of not more than 30 microns) an effective amount of phosphorus-containing alloy powder, carbon powder, Fe-Mo alloy powder and a copper-containing powder, granulating the iron powder alone or in combination with other of said powders to an apparent particle size of from 30 to 200 microns, forming the obtained powder mixture into a green compact having a density ratio of from 70 to 90 percent, and sintering the green compact in a reducing atmosphere at a temperature of from 1030° to 1130° C.

5. A process according to claim 4 wherein the green compact has a density ratio of from 75 to 85 percent.

6. A process according to claim 5 wherein the copper-containing powder is copper powder.

7. A process according to claim 5 wherein the copper-containing powder comprises bronze powder.

8. A process according to claim 5 wherein the copper-containing powder comprises a mixture of copper powder and tin powder.

9. A process according to claim 5 wherein said green compact comprises from 5 to 20 percent of copper or copper alloy.

10. A process according to claim 5 wherein the phosphorus-containing alloy powder is Fe-P alloy powder or Cu-P alloy powder and comprises from 0.2 to 1.5 percent (calculated as elemental phosphorus) of said green compact.

11. A process according to claim 5 wherein the carbon powder comprises from 1 to 3 percent of said green compact.

12. A process according to claim 5 wherein molybdenum of the Fe-Mo alloy powder comprises from 3 to 15 percent of said green compact.

13. A process for preparing an iron-base sintered alloy, well suited for use in valve mechanism members or parts of internal combustion engines, which has a porosity of from 5 to 15% and throughout the iron matrix of which is dispersed from 5 to 25% of an Fe-Mo intermetallic compound in the form of a phase harder than the said matrix, which comprises:

admixing an effective amount of each of phosphorus-containing alloy powder, carbon powder, Fe-Mo alloy powder and a copper-containing powder with finely-divided atomized or reduced iron powder having a particle size of not more than 30 microns and comprising in excess of 50 percent of the resulting admixture, forming the obtained powder mixture into a green compact having a density ratio of from 70 to 90 percent, and sintering the green compact in a reducing atmosphere at a temperature of from 1030° to 1130° C.

14. An iron-base green compact having a density ratio of from 70 to 90 percent and comprising:

from 5 to 20 percent of copper or copper alloy powder, from 0.2 to 1.5 percent (calculated as elemental phosphorus) of Fe-P alloy powder or Cu-P alloy powder, from 1 to 3 percent of carbon powder, and from 3 to 15 percent (calculated as elemental molybdenum) of Fe-Mo powder.

15. A green compact according to claim 14 comprising finely-divided iron powder having a particle size of not more than 30 microns.

16. A green compact according to claim 15 wherein the iron powder is in the form of granules having an apparent particle size of from 30 to 200 microns.

17. A sintered compact having a porosity ranging from 5 to 15 percent and an iron-base alloy matrix or substrate throughout which is dispersed a hard-phase Fe-Mo intermetallic compound in an area ratio of from 5 to 25 percent, the compact being that of a green compact according to claim 14.

18. A sintered compact according to claim 17 wherein the green compact has a density of from 75 to 85 percent.

19. A green compact according to claim 14 wherein the iron comprises in excess of 50 percent and is derived from atomized iron powder or reduced iron powder.

* * * * *